US005489138A

United States Patent [19]

Mariol et al.

[11] Patent Number: 5,489,138

[45] Date of Patent: Feb. 6, 1996

[54] HEIGHT ADJUSTABLE HIGH CHAIR

[75] Inventors: John V. Mariol, Cincinnati; Paul K. Meeker, Hiram, both of Ohio

[73] Assignee: Lisco, Inc., Tampa, Fla.

[21] Appl. No.: 130,207

[22] Filed: Oct. 1, 1993

[51] Int. Cl.[6] ..... A47B 83/02

[52] U.S. Cl. ..... 297/151; 297/153; 297/344.14; 297/344.18

[58] Field of Search ..... 297/149, 151, 297/153, 344.18, 344.13, 344.14

[56] References Cited

U.S. PATENT DOCUMENTS

| | | | |
|---|---|---|---|
| 256,272 | 4/1882 | Bent . | |
| 1,566,664 | 12/1925 | Freakes | 297/344.18 X |
| 2,485,111 | 10/1949 | Robins | 297/344.18 X |
| 2,505,490 | 4/1950 | Greenbaum | 155/127 |
| 2,624,395 | 1/1953 | Johnson | 297/344.18 X |
| 3,097,884 | 7/1963 | Alford | 297/153 |
| 4,723,813 | 2/1988 | Kassai | 297/149 X |
| 4,807,928 | 2/1989 | Cone | 297/153 |
| 4,938,603 | 7/1990 | Turner et al. | 297/16 |
| 4,968,092 | 11/1990 | Giambrone | 297/151 |
| 5,118,161 | 6/1992 | Slowe et al. | 297/153 |
| 5,131,719 | 7/1992 | Kassai | 297/151 X |
| 5,238,292 | 8/1993 | Golenz | 297/149 X |
| 5,348,374 | 9/1994 | Kuo | 297/344.18 |

FOREIGN PATENT DOCUMENTS

| | | | |
|---|---|---|---|
| 2513103 | 10/1976 | Germany | 297/344.18 |
| 72803 | 10/1945 | Norway | 297/153 |
| 464806 | 4/1937 | United Kingdom | 297/149 |
| 887550 | 1/1962 | United Kingdom | 297/344.18 |

*Primary Examiner*—Peter R. Brown
*Assistant Examiner*—David E. Allred

[57] ABSTRACT

An adjustable high chair for use by a child comprising a base having a horizontal portion with a center of gravity and positionable on a floor with a chair adapted to receive a child thereon, the chair having a seat portion, a back portion, and portions coupled with respect thereto, the arm portions each having an upper support surface for receipt of a tray, height adjustment mechanisms operatively coupling the base and the chair and a tray adjustably secured with respect to the arms of the chair.

3 Claims, 5 Drawing Sheets

HEIGHT ADJUSTABLE HIGH CHAIR

BACKGROUND OF THE INVENTION

1. Field of the Invention

This invention relates to an improved height adjustable high chair and, more particularly, to an improved height adjustable high chair which is height adjustable vertically and which allows for adjustment of the tray in a horizontal plane.

2. Description of the Background Art

Many types of high chairs are known and in wide use today throughout the child care industry. High chairs have a very large number of features generally designed for the safety of the child and convenience of the mother. Aspects of an improved height adjustable high chair which are taken in account when designing or utilizing such high chairs are the ability of the high chair to maintain a stable orientation with respect to the ground for precluding tipping of the chair and child. Another feature of concern is the ability of the chair, with or without a tray, to situate a child at a convenient elevational height vertically with respect to the mother particularly during feeding time. A third aspect of concern in the design of high chairs is the ability of the tray to be located in a proper orientation in a horizontal plane with regard to the size of the particular child.

Typical examples of high chairs directed to providing various of the features discussed above as well as other features are described throughout the patent literature. By way of example, U.S. Pat. No. 4,807,928 to Richard E. Cone which discloses a tray apparatus that provides for an attachment to an improved height adjustable high chair. The tray apparatus includes a tray having a raised periphery. Raised arm or elbow rest areas are formed at the back of the tray. Peripheral portions, which are located at the back of the tray, decrease in height in a direction from the outer periphery. The tray apparatus also includes a latching mechanism that provides a number of functions including adjustment of the tray relative to the high chair while maintaining engagement between the tray apparatus and the high chair; one-handed or two-handed removal of the tray apparatus from the high chair; and a memory feature which facilitates removal of the tray apparatus and attachment thereof at the same position relative to the high chair.

U.S. Pat. No. 4,938,603 to Turner discloses a lock-release mechanism mounted on the back of a foldable high chair to control relative movement between the chair back and the underlying seat and leg assembly. In use, the bolt-release mechanism can be actuated manually to permit the high chair to be folded from an unfolded use position to a partly folded safety stop position and a fully folded storage position.

Giambrone, in U.S. Pat. No. 4,968,092, discloses an improved height adjustable high chair tray latch mechanism comprising a housing secured to the underside of an improved height adjustable high chair tray with movable latches on the opposed side of the housing for engaging apertures in the arms of the chair. A bell crank is rotatably mounted centrally within the housing between the movable latches. First and second rigid rods are pivotally attached at one end to opposite arms of the bell crank and the first and second arms are pivotally attached at their other ends to their respective latches. The crank includes a spring which rotatably biases the crank in a direction to engage the latches with the holes in the arms of the chair. A cable is connected between the crank and a lever located on the underside of the forward part of the tray. Manual squeezing of the lever relative to the tray foreshortens the cable so as to rotate the crank. Rotation of the crank overcomes the bias of the spring and the rigid rods release the latches outwardly from the holes in the arms of the high chair so that the tray may be adjusted or removed.

U.S. Pat. No. 5,118,161 to Slowe discloses a device for releasably securing a tray to a chair having two extending arms with a plurality of consecutive recessed grooves on the underside of each arm. The device comprises a one-piece pivot bar and a pivot element for pivotably connecting the pivot bar to the bottom of the tray. The pivot bar comprises an operable front portion forward of the pivot element, a back portion rearward of the pivot element, and at least two pins extending from the back portion for engaging the grooves. Attachment elements are included which are located proximate the pivot element for rotatably securing the pivot bar to the bottom of the tray. A biasing element is associated with the pivot bar for urging the pins toward the bottom surface of the tray and into corresponding grooves when the tray is positioned on the arms of the chair to secure the tray to the arms whereby operation of the pivot bar in opposition to the biasing means causes the pins to retreat from the grooves.

Disclosed in U.S. Pat. No. 256,272 is a chair having seat, arms, and spindles, a removable tray or shelf having two horizontally-projecting bars, one fixed and one pivoted to the tray on a vertical axis, and both adapted to engage with the chair by means of pins and sockets, as described, and to be held in engagement by a locking device, substantially as and for the purpose as set forth.

U.S. Pat. No. 2,505,490 to Greenbaum discloses the combination with a chair, of fixtures fastened to each side thereof, a tray, arms pivotally mounted on the tray, spring means for normally tensioning the arms towards each other thus engaging the fixtures, and a handle operatively connected to the arms to force them in the opposite direction.

Lastly, Alford, in U.S. Pat. No. 3,097,884, discloses a tray adapted to be removably connected to transversely spaced vertical tubular members of a chair in which lower enlargements are provided, the tray comprising a board having transversely spaced recesses into which the chair members are adapted to fit, hook members carried by the board on the under side thereof to partly encircle the chair members, means to lock the hook members to retain the chair members in their recesses, the means comprising pivoted hook-provided locking dogs and means to move the dogs on their pivots between retracted and partly encircling engagement with the chair members, and brace means carried by the board and angularly directed to engage the lower portions of the chair members and to rest upon the enlargements thereof.

A review of the prior art illustrates that no patent addresses and meets the variety of needs of both mother and child when it comes to high chair safety and convenience.

Accordingly, it is an object of the present invention to provide an adjustable high chair for use by a child comprising a base having a horizontal portion with a center of gravity and positionable on a floor, a chair adapted to receive a child thereon, the chair having a seat portion, a back portion, and arm portions coupled with respect thereto, the arm portions each having an upper support surface for receipt of a tray, height adjustment mechanisms operatively coupling the base and the chair and a tray adjustably secured with respect to the arms of the chair.

further object of the invention is to adjust the height of an improved height adjustable high chair conveniently to facilitate the desires of the mother for a particular time or place.

A further object of the present invention to laterally move a tray and secure it in a proper orientation with respect to the chair within the high chair.

A further object of the present invention is to effect the adjustment of an improved height adjustable high chair through mechanisms convenient to the mother which will assure that the tray is not inadvertently removed during the adjustment of the tray position.

A further object of the present invention is to maintain the stability of an improved height adjustable high chair and child therein by insuring its center of gravity is as close as possible to the center of gravity of the base during adjustment thereof.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention may be incorporated into an adjustable high chair for use by a child comprising a base having a generally horizontal portion with a center of gravity and positionable on a floor, a chair adapted to receive a child thereon, the chair having a seat portion, a back portion, and arm portions coupled with respect thereto, the arm portions each having an upper support surface for receipt of a tray and parallel side faces with recesses to effect adjustable engagement of a tray with respect to the chair, the recesses being in a spaced essentially horizontal orientation with end stops located at the forward and rearward ends of the recesses, height adjustment mechanisms operatively coupling the base and the chair, the mechanisms including tubes extending upwardly from the base at an angle with respect to the vertical with holes for height adjustment purposes, tubular bearing surfaces associated the back portion of the chair slidably receiving the tubes, latch means coupling the tubes and bearing surfaces for selective engagement therebetween, and an operator-controlled handle adjacent to the top of the chair to affect selective engagement and disengagement of the latch means with respect to the holes to vary the elevation of the chair with respect to the base and to laterally shift the chair with respect to the base for moving the chair toward a more stable position over the center of gravity of the base as the chair is raised and a tray adjustably secured with respect to the arms of the chair, the tray having operator-controlled pivotable handles with fingers spring urged into engagement with the recesses of the arm portions but movable out of engagement with the recesses by an operator in order to slide the tray between a plurality of recesses and positions as well as outwardly of the end stops for disengagement with the chair, the tray having a central reciprocable handle extending outwardly from the front edge of the tray movable by an operator, rods coupling the reciprocal handle and pivotable handles to move the pivotable handles to an extent sufficient whereby the fingers will move out of the recesses to allow adjustment of the tray with respect to the chair but insufficient for the fingers to clear the end stops to thereby preclude removal of the tray from the chair.

The foregoing has outlined rather broadly, the more pertinent and important features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

Similar reference numerals refer to similar parts throughout the several Figures.

DETAILED DESCRIPTION OF THE PREFERRED EMBODIMENT OF THE INVENTION

Figure 1:
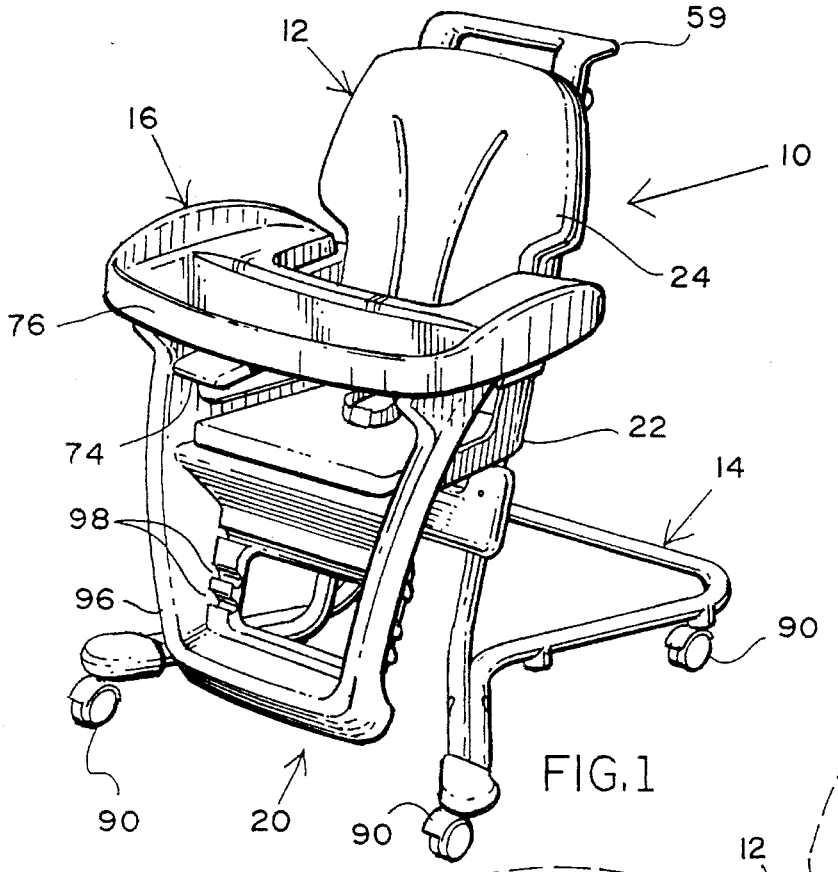
FIG. 1 is a front perspective illustration of an improved height adustable high chair constructed in accordance with the principles of the present invention.
Figure 2:
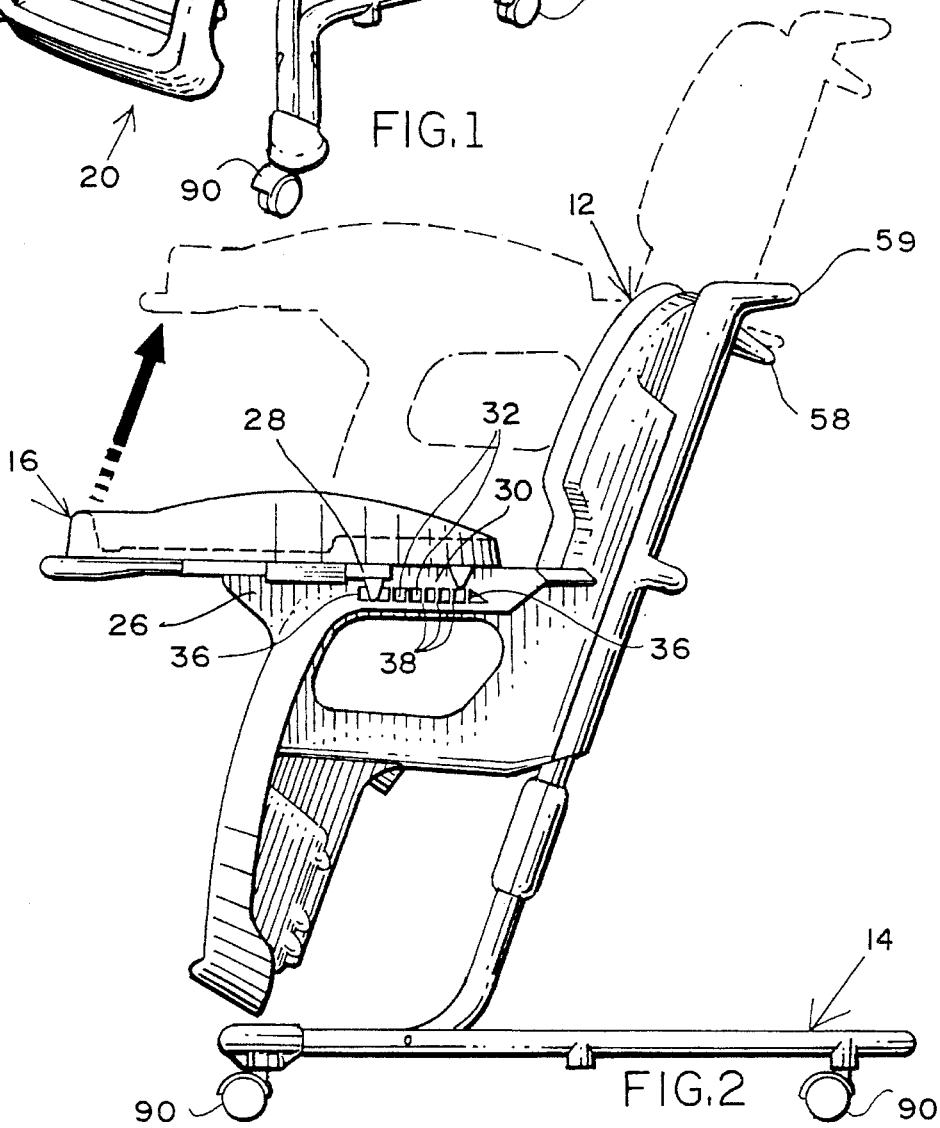
FIG. 2 is a side elevational view of the high chair of the prior Figure illustrating various elevational orientations.
Figure 4:
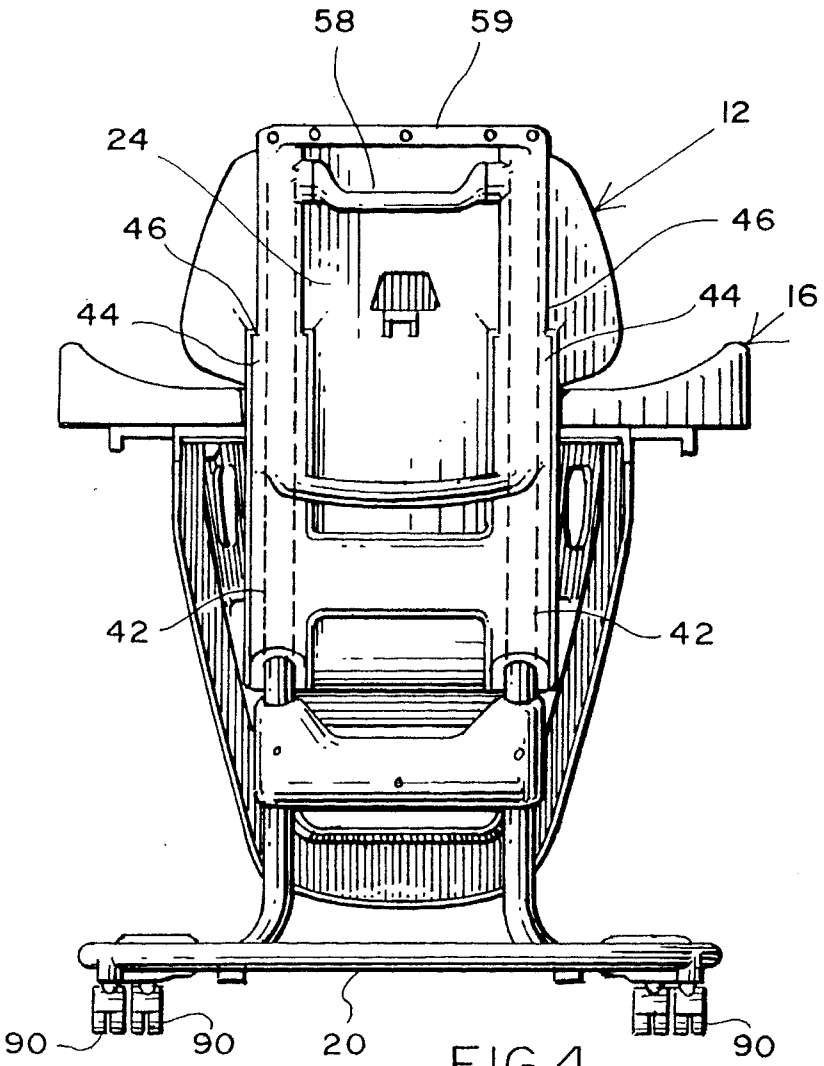
FIGS. 3 and 4 are front and rear elevational views of the high chair of FIGS. 1 and 2.
Figure 3:
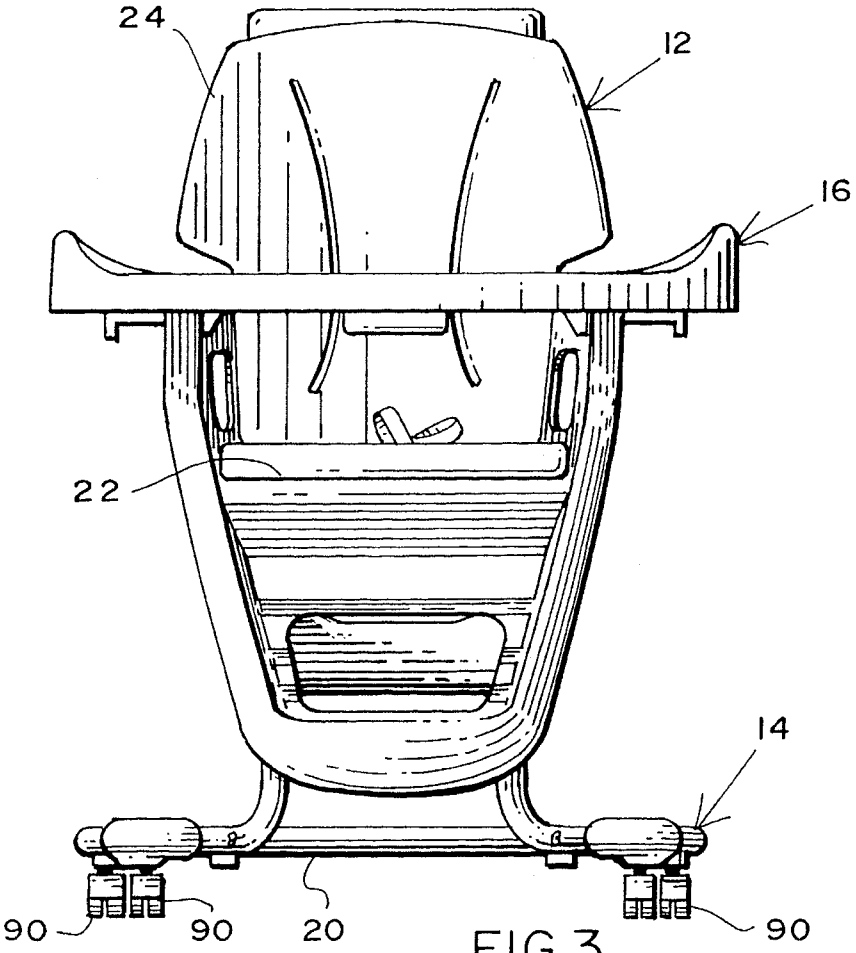
Figure 6:
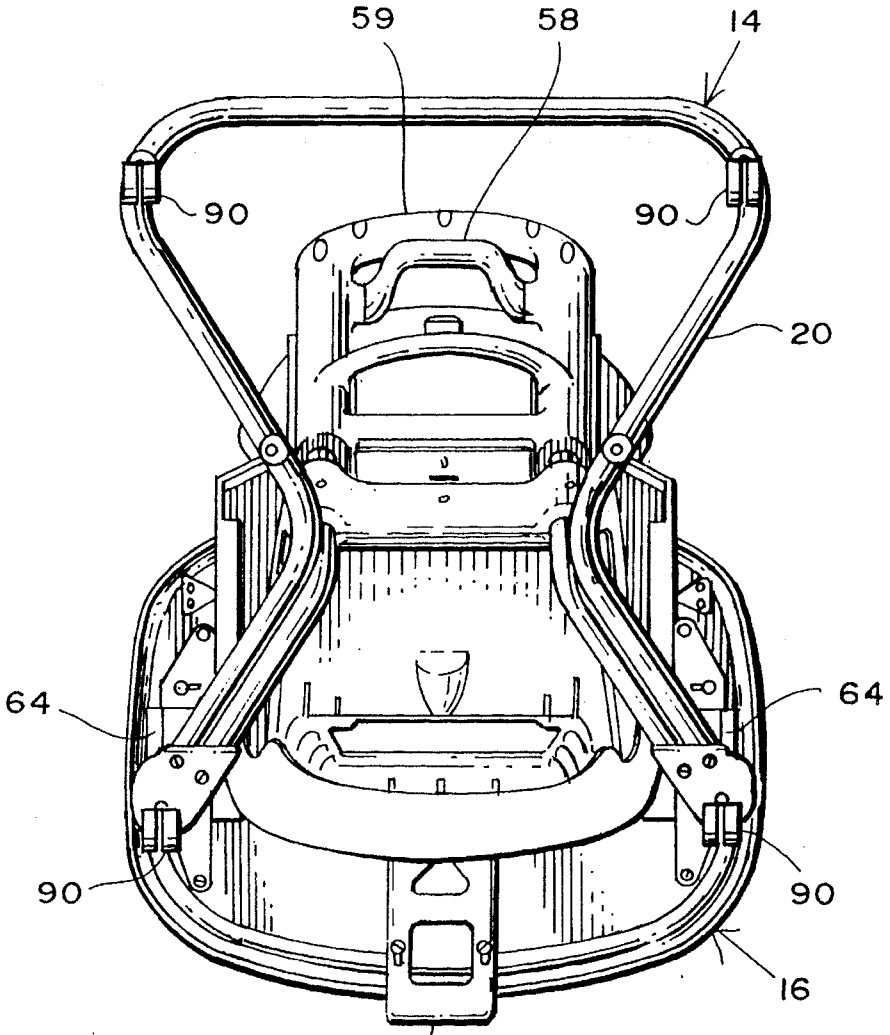
FIGS. 5 and 6 are top and bottom views of the high chair if the prior Figures.
Figure 5:
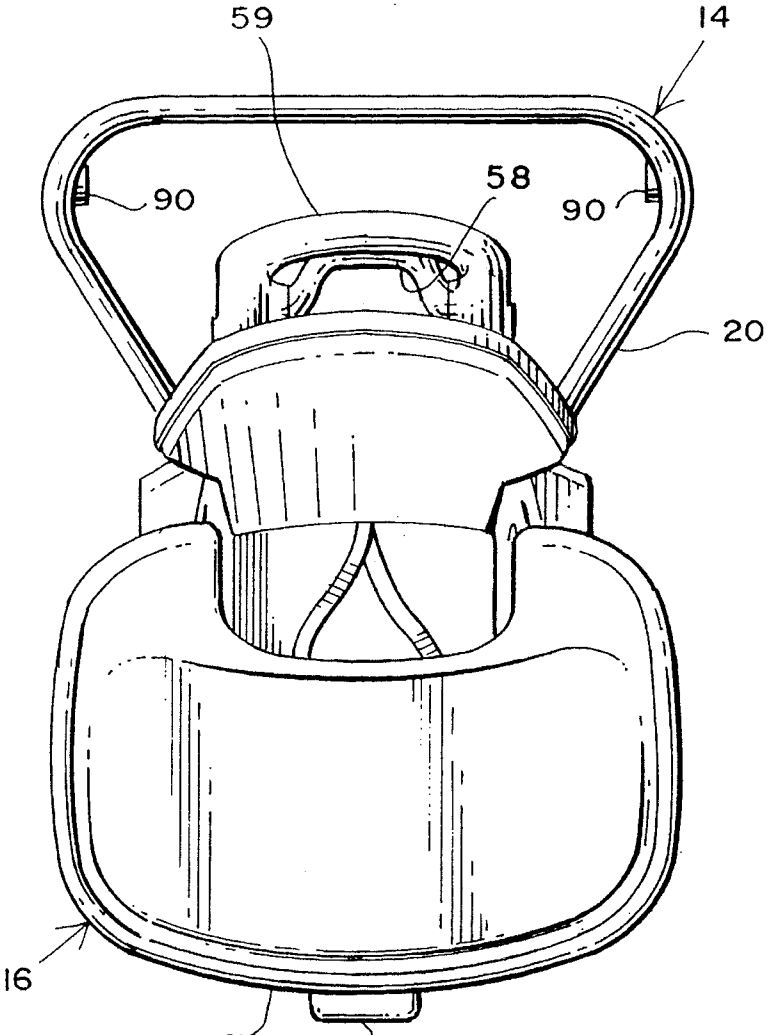
Figure 7:
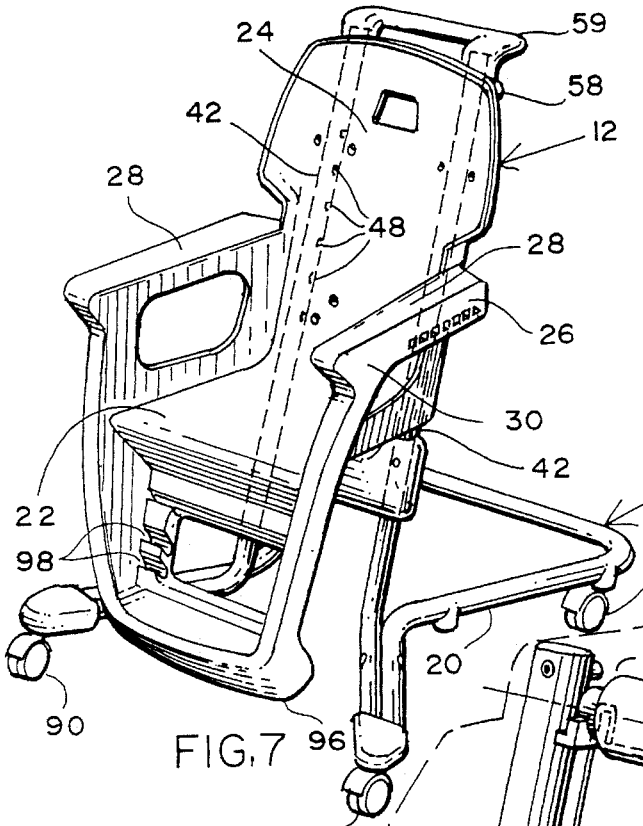
FIG. 7 is a perspective illustration of the high chair with the padding and other elements removed.
Figure 9:
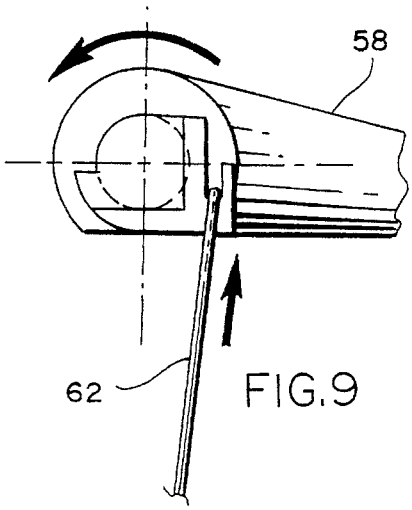
FIG. 9 is a side elevation view showing the upper extent of the rails and associated handle.
Figure 8:
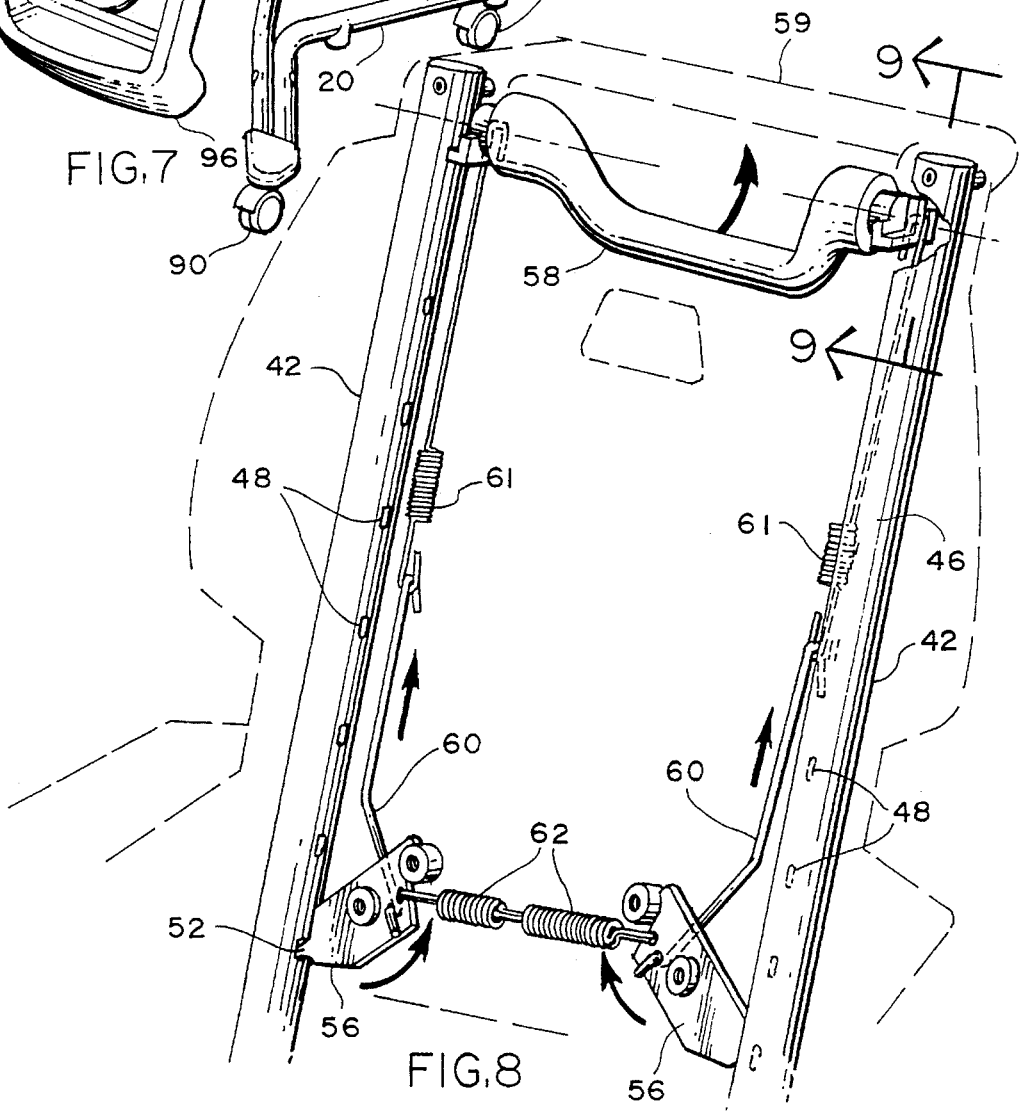
FIG. 8 is an enlarged perspective illustration of the upper part of the high chair taken from the rear with parts removed to show internal constructions.
Figure 10:
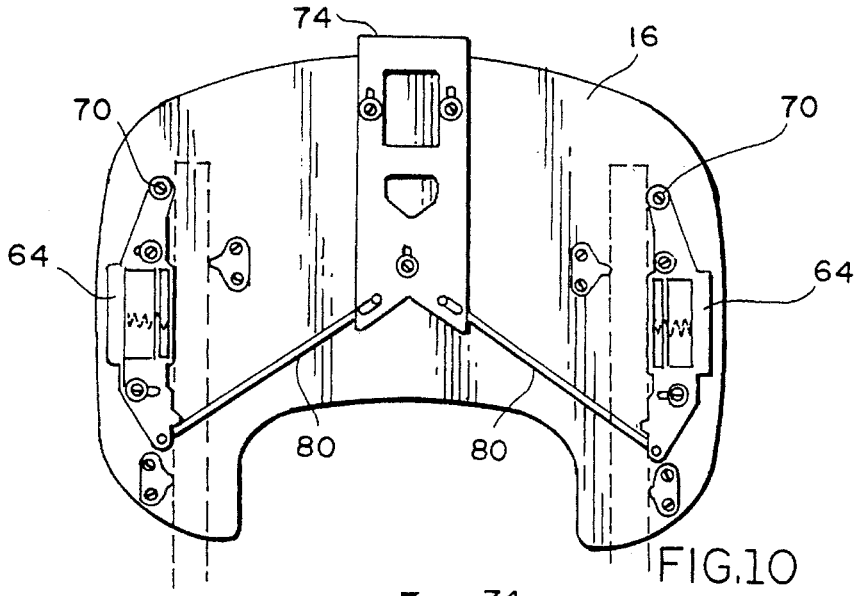
FIGS. 10, 11 and 12 are bottom views of the tray in various positions for adjustment.
Figure 11:
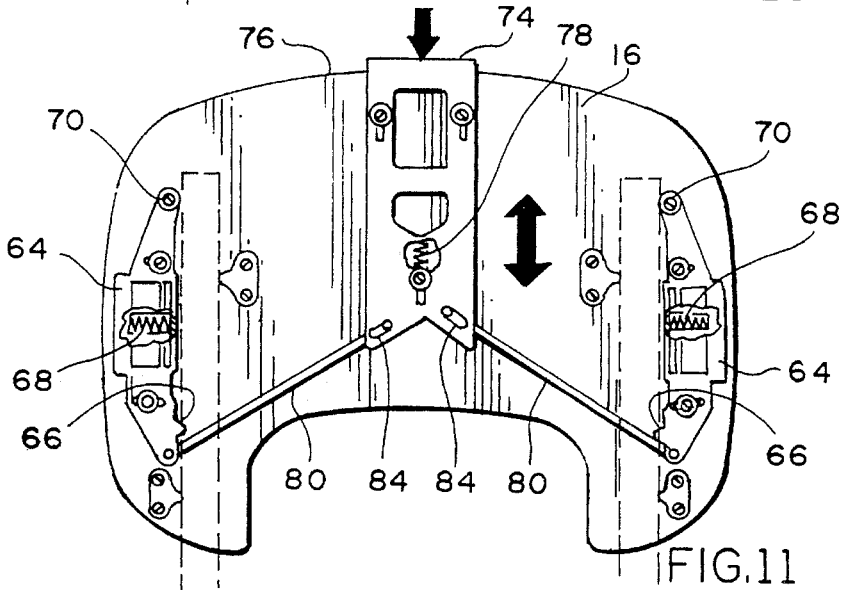
Figure 12:
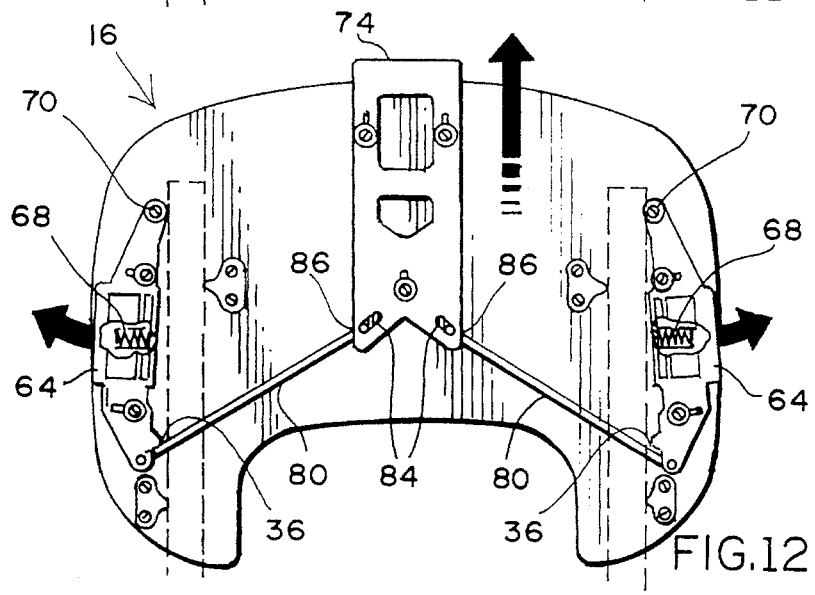

Shown in the Figures, with particular reference to FIG. 1, there is shown an improved height adjustable high chair 10 constructed in accordance with the principles of the present invention. The high chair assembly 10 includes in general terms, a chair 12, a base 14, coupling members therebetween and a tray 16 for the chair. The chair is adjustable through operator-controlled mechanisms for vertical movement to raise or lower the chair. The tray is adjustable through operator-controlled mechanisms for movement toward or away from a child in the chair on a horizontal plane.

More specifically, the base 14 has a portion with rails shaped to define a horizontal lower portion 20 positionable adjacent to the floor. The floor contacting areas of the base are widely spaced for increased stability. A center of gravity for the assembly is located centrally within the periphery of the base 14 which contacts the floor.

At the upper extent of the assembly is a chair 12 adapted to receive a child thereon. The chair, as is conventional, has a seat portion 22, a back portion 24, and arms portions 26 coupled with respect with each other. Padding in the form of a cushion is provided for the seat and backing in a manner which is conventional. The arm portions each have an upper support surface 28 for receipt of a tray. On the sides of the arm portions are parallel side faces 30. Each side face has a series of aligned recesses 32. The recesses function in association with fingers 34 on a tray 16 to effect adjustable engagement of the tray with respect to the chair. The recesses are spaced in an essentially vertical orientation.

At the front and back of the recesses 32 are end stops 36. The end stops 36 project outwardly from the side faces of the side walls a distance greater than the intermediate walls 38 between the recesses. The purpose of such configuration will be discussed hereinafter.

Height adjustment mechanisms are provided to operatively couple the base 14 and the chair 12. Such mechanisms include a pair of parallel tubes 42 with a cross brace extending upwardly from the base at an angle of between about 10 to 20 degrees with respect to the vertical. Such mechanisms also include bearing surfaces formed within the rear housing 46 of the back portion 24 of the chair 12. The bearing surfaces are in the form of generally vertical sleeves 44 of a diameter and length to slidably receive the tubes 42. Holes 48 are formed in the tubes along the length thereof for height adjusting purposes.

To effect the height and adjusting purposes, latches 52 couple the tubes 42 and the rear housing 46 and chair 12. The latches take the form of pivotable fingers 56 within the rear housing 46 of the back portion 24 of the chair 12.

An operator-controlled handle 58 is pivotally secured to the top of the chair. Such handle is located in association with a fixed handle 59. The handle 58 is coupled to the fingers 56 through rods 60 and springs 61 to effect their movement to selectively engage and disengage the latches. Disengagement of the fingers 56 from the holes 48 will allow a user to raise or lower the chair to vary the elevation of the chair with respect to the base. Release of the handle causes a spring 62 to urge the fingers into locking engagement with holes 48.

Lifting of the chair allows the chair to expose a greater extent of the lower portion of the tubes. The lifting of the chair also acts to laterally shift the chair with respect to the base due to the angled orientation of tubes and bearing surfaces. This action will also act to move the chair toward a more stable position toward a location over the center of gravity of the base and assembly as the chair is raised.

The final major component of the assembly is the tray 16. The tray 16 is adjustably secured with respect to the arms of the chair. It has operator controlled pivotable side handles 64 with attached fingers 66. The handles 64 and fingers 66 are urged by spring 68 inwardly about pivot pins 70 into engagement with the recesses 32 on the side faces of the arm portions 26. The fingers 66, however, are movable out of engagement with the recesses 32 by an operator in order to slide the tray between a plurality of positions defined by the recesses 32 which receive the fingers 66. The handles 64 when fully retracted pull the fingers outwardly to beyond the end stops 36 to allow for movement of the tray to a position out of engagement with the chair.

The tray also has a reciprocable central handle 74 extending outwardly from the front edge 76 of the tray 16. Such central handle 74 is movable inwardly by an operator against the action of a spring 78 to move rods 80 outwardly.

Such rods 80 are coupled to the reciprocal pivotable handles 64. Such action allows the pivotable handles 64 to move to an extent sufficient whereby the fingers will move out of the recesses to allow adjustment of the tray with respect to the chair. But due to the depth of the slots 84 on the handle 74 which receive the rod ends 86, withdrawal of the rod ends is insufficient for the fingers 66 to clear the end stops 36. This relationship precludes removal of the tray 16 with respect to the chair 12 while still allowing adjustment of the tray 16 in a horizontal plane with respect to the chair 12 and child supported therein.

Additional features for providing increased utility include lockable casters 90 removably secured to the lower surface of the base 14 to allow for greater ease in relocating the improved height adjustable high chair.

In addition, a U-shaped leg support 96 depends from the lower surface of the tray 16 adjacent to its forward edge. Therebetween is a leg support 98. The leg support is fixedly positioned to provide support for a child's legs.

One last feature involves the use of the chair 12 and base 14 without the tray 16. As can be understood, with the tray 16 removed, a child in the chair may be moved to any table of any height.

The present disclosure includes that contained in the appended claims as well as that of the foregoing description. Although this invention has been described in its preferred form with a certain degree of particularity, it should be understood that the present disclosure of the preferred form has been made only by way of example and that numerous changes in the details of construction and combination and arrangement of parts may be resorted to without departing from the spirit and scope of the invention.

Now that the invention has been described,

What is claimed is:

1. An adjustable high chair for use by a child comprising, in combination:

a base having a generally horizontal portion with a central extent and positionable on a floor;

a chair adapted to receive a child thereon, the chair having a top and a bottom and a seat portion, a back portion, and arm portions coupled with respect thereto, the arm portions each having an upper support surface for receipt of a tray and parallel side faces with a row of recesses to effect adjustable engagement of a tray with respect to the chair, the row or recesses having forward and rearward ends and with end stops located at the forward and rearward ends of the recesses, the chair being operatively coupled to the base;

height adjustment mechanisms operatively coupling the base and the chair, the mechanisms including tubes extending upwardly from the base at an angle with respect to the vertical with holes for height adjustment purposes, tubular bearing surfaces associated with the back portion of the chair slidably receiving the tubes, latch means coupling the tubes and bearing surfaces for selective engagement therebetween, and an operator-controlled handle adjacent to the top of the chair to effect selective engagement and disengagement of the latch means with respect to the holes to vary the elevation of the chair with respect to the base and to laterally shift the chair with respect to the base for moving the chair toward a more stable position over the central extent of the base as the chair is raised; and a tray adjustably secured with respect to the arm portions of the chair, the tray having a front edge and a rear edge and operator-controlled pivotable handles with fingers spring urged into engagement with the recesses of the arm portions but movable out of engagement with the recesses by an operator in order to allow sliding the tray among a plurality of positions as well as outwardly of the end stops for disengagement with the chair, the tray having a central reciprocable handle extending outwardly from the front edge of the tray movable by an operator, rods coupling the reciprocal handle and pivotable handles to move the pivotable handles to an extent sufficient whereby the fingers will move out of the recesses to allow adjustment of the tray with respect to the chair but insufficient for the fingers to clear the end stops to thereby preclude removal of the tray from the chair.

2. An adjustable high chair for use by a child comprising, in combination:

a base having a horizontal portion positionable on a floor;

a chair adapted to receive a child thereon, the chair having a seat portion, a back portion, and arm portions, the arm portions each having an upper support surface for receipt of a tray and parallel side faces with recesses to effect adjustable engagement with a tray with respect to the chair, the recesses being in rows in an essentially horizontal orientation with the rows having front ends and rear ends and with end stops located at the ends of the rows of recesses;

support means coupling the base and the chair; and a tray adjustably secured with respect to the arm portions of the chair, the tray having a front edge and a rear edge and operator-controlled pivotable handles with fingers spring urged into engagement with the recesses of the arm portions but movable out of engagement with the recesses by an operator in order to slide the tray among a plurality of positions as well as outwardly of the end stops for disengagement with the chair, the tray having a central reciprocable handle extending outwardly from the front edge of the tray movable by an operator, rods coupling the reciprocal handle and pivotable handles to move the pivotable handles to an extent sufficient whereby the fingers will move out of the recesses to allow adjustment of the tray with respect to the chair but insufficient for the fingers to clear the end stops to thereby preclude removal of the tray from the chair.

3. An adjustable high chair for use by a child comprising, in combination:

a base having a horizontal portion with a lower surface and positionable on a floor;

a chair operatively coupled to the base and adapted to receive a child thereon, the chair having a seat portion with a front edge and a rear edge, a back portion, and arm portions, the arm portions each having an upper support surface for receipt of a tray; and a tray adjustably secured with respect to the arm portions of the chair, the tray having a front edge and a rear edge and operator-controlled pivotable handles with fingers spring urged into engagement with the recesses of the arm portions but movable out of engagement with the recesses by an operator in order to slide the tray among a plurality of positions as well as outwardly of the end stops for disengagement with the chair, the tray having a central reciprocable handle extending outwardly from the front edge of the tray movable by an operator, rods coupling the reciprocal handle and pivotable handles to move the pivotable handles to an extent sufficient whereby the fingers will move out of the recesses to allow adjustment of the tray with respect to the chair but insufficient for the fingers to clear the end stops to thereby preclude removal of the tray from the chair.

* * * * *